United States Patent [19]

Tominaga et al.

[11] Patent Number: 4,687,205

[45] Date of Patent: Aug. 18, 1987

[54] IRON TYPE GOLF CLUB HEAD

[75] Inventors: Ichiro Tominaga; Teruo Sasaki, both of Kobe, Japan

[73] Assignee: Simitomo Rubber Industries, Ltd., Japan

[21] Appl. No.: 639,186

[22] Filed: Aug. 9, 1984

[30] Foreign Application Priority Data

Aug. 20, 1983 [JP] Japan ..... 58-151966

[51] Int. Cl.[4] ..... A63B 53/04

[52] U.S. Cl. ..... 273/169; 273/DIG. 29

[58] Field of Search ..... 273/169, 171, 172; 75/229, 167 R, 167 F, 167 K, 168, 170

[56] References Cited

U.S. PATENT DOCUMENTS

| | | | |
|---|---|---|---|
| 3,218,072 | 11/1965 | Burr | 273/169 X |
| 3,889,348 | 6/1975 | Lemelson | 75/229 X |
| 3,995,865 | 12/1976 | Cochran et al. | 273/171 X |
| 4,181,306 | 1/1980 | Jepson | 273/167 R |
| 4,204,684 | 5/1980 | Molitor | 273/173 |
| 4,444,395 | 4/1984 | Reiss | 273/171 |

FOREIGN PATENT DOCUMENTS

| | | | |
|---|---|---|---|
| 1232651 | 5/1971 | United Kingdom | 273/171 |

*Primary Examiner*—George J. Marlo

*Attorney, Agent, or Firm*—Birch, Stewart, Kolasch & Birch

[57] ABSTRACT

An iron type golf club head comprising a composite material of light metal or synthetic resin containing silicon carbide whiskers at 2 to 80% by volume and occupying 20% or more by volume of the body of the club head. The club head can be 10 to 60% lighter than a club head made entirely of steel with the same configuration and size, while the moment of inertia is approximately the same. Weight metal inserts having a specific gravity greater than steel can also be embedded in the club head.

23 Claims, 10 Drawing Figures

IRON TYPE GOLF CLUB HEAD

BACKGROUND AND SUMMARY OF THE INVENTION

This invention relates to an iron type golf club head.

For wood type golf club heads, various kinds of materials have generally been used. For example, as disclosed in U.S. Pat. Nos. 4,181,306 and 4,204,684, many kinds of materials such as wood, synthetic resin, and metal are used.

However, with regard to an iron type golf club head, the use of light metal or synthetic resin for a major part of the club head has been considered difficult because of a limitation on the strength inherent in the configuration and size specific to the iron type club head and, therefore, mild steel or stainless steel has solely been used.

On the other hand, a well-known procedure is to increase the moment of inertia by embedding weight inserts into the wood type club head as disclosed in U.S. Pat. No. 4,204,684.

However, the use of weight inserts, such as those made of lead, into the iron type club head made of mild steel or stainless steel as described above increases the weight of the club head and makes swinging of the golf club difficult.

It is therefore an object of the present invention to provide an iron type golf club head easy to swing for physically weak players while maintaining sufficient strength of the club head as well as the moment of inertia around the center of gravity of the club head at the same approximate level as that of a conventional one and, further, reducing the weight of the club head.

Another object of the present invention is to provide an iron type golf club head to decrease the deviation angle of a golf ball which is mishit, that is, a ball which hits on a spot other than the so-called sweet spot of the club head, and the drop of initial speed of the golf ball while maintaining the weight of the club at the same approximate level as that of a conventional one but increasing the moment of inertia around the center of gravity.

Other object, features and advantages of the present invention will become apparent from the accompanying drawings and the following description.

According to the present invention, there is provided an iron type golf club head comprising a composite material which is made of light metal containing silicon carbide whiskers and occupies 20% or more by volume of the body of the club head.

The present invention further provides an iron type golf club head comprising a composite material which is made of synthetic resin containing silicon carbide whiskers and occupies 20% or more by volume of the body of the club head.

Furthermore, the present invention provides an iron type club head comprising a composite material which is made of light metal containing silicon carbide whiskers and occupies 20% or more by volume of the body of the club head so that the weight of the club head is reduced by 10 to 60% so as to be lighter than a club head made entirely of steel and having the same configuration and size as those of the aforesaid club head with the condition that the moment of inertia of one club head is maintained at approximately the same degree as that of the other.

Still further, the present invention provides an iron type golf club head comprising a composite material which is made of synthetic resin containing silicon carbide whiskers and occupies 20% or more by volume of the body of the club head so that the weight of the club head is reduced by 10 to 60% to be lighter than a club head made entirely of steel and having the same configuration and size with the condition that the moment of inertia of one club head is maintained at approximately the same degree as that of the other.

Further, the present invention provides an iron type golf club head comprising a composite material which is made of light metal containing silicon carbide whiskers and forms a major part of the club head, provided with metal weight inserts each having a specific gravity greater than that of steel and embedded into portions lying apart from the center of gravity of the club head and on the toe side as well as on the heel side thereof, and adapted to possess the increased moment of inertia around the center of gravity with the condition that the configuration, size, and weight of the above club head are identical with those of a club head made entirely of steel.

The present invention still further provides an iron type golf club head comprising a composite material which is made of synthetic resin containing silicon carbide whiskers and forms a major part of the club head, provided with metal weight inserts each having a specific gravity greater than that of steel and embedded into portions lying apart from the center of gravity of the club head and on the toe side as well as on the heel side thereof, and adapted to possess the increased moment of inertia around the center of gravity with the condition that the configuration, size, and weight are identical with those of a club head made entirely of steel.

BRIEF DESCRIPTION OF THE DRAWING

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Referring now to the accompanying drawings, and in particular to FIGS. 1 and 2, an iron type golf club head 2*a* is fashioned of a composite material 12*a* as will be described later which occupies 20% or more by volume of the entire body of the club head.

The composite material 12*a* is made of light metal containing silicon carbide (SiC) whiskers. As the light metal, aluminum, aluminum alloy, magnesium, magnesium alloy, titanium, or titanium alloy can be used.

A silicon carbide (SiC) whisker is a complete needle-like crystal having a diameter ranging from 0.1 to 10 μm, a length ranging from 50 to 200 μm, an aspect ratio (namely, length/diameter) ranging from 50 to 300, and a density of about 3.2 g/cm$^3$.

The content of silicon carbide whiskers in the composite material 12*a* is set within the range of from 2 to 80% by volume. A particularly preferable content ranges from 4 to 40% by volume. Further, the specific gravity (density) of the composite material is preferably set to be 40% or under the specific gravity (density) of steel.

Parts of the club head other than that made of the abovesaid composite material 12*a* occupying 20% or more of the entire volume of the club head are made of metal which has a high specific gravity (density), for example, lead, tungsten or steel.

Figure 1:
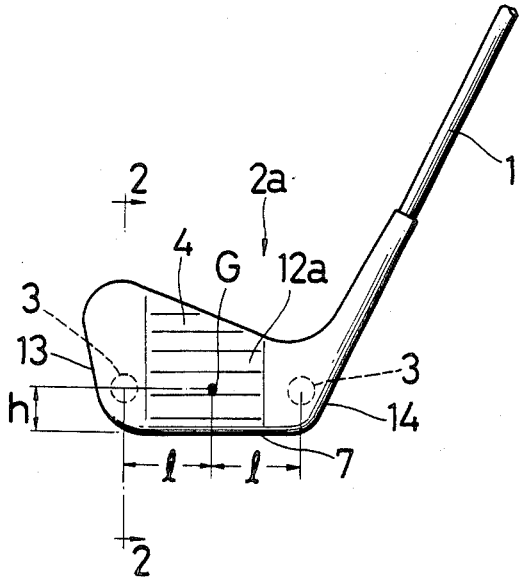
FIG. 1 is a front elevational view of an iron type golf club head of the present invention.
Figure 2:
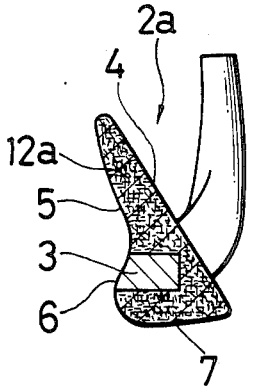
FIG. 2 is an enlarged cross sectional view taken along the line 2—2 of FIG. 1.

In FIGS. 1 and 2, a pair of weight inserts 3 and 3 are embedded into the club head from the reverse side 5 thereof and securely fixed thereto. In other words, blind holes 6 and 6 are provided on the reverse face 5 which forms a side opposite to the impact front face 4 of the club head, and weight inserts 3 and 3 are inserted into these blind holes 6 and 6 firmly fixed thereto. As apparent from FIG. 1, when viewed from the front face of the club head 2*a*, weight inserts 3 and 3 are fixed apart from the center of gravity G of the club head 2*a* at equal distances l and l toward the sides of toe 13 and heel 14. Further, the weight inserts 3 and 3 are fixed at height h above the sole 7 of the club head, the height h being equal to the distance between the sole 7 and the center of gravity G of the club head. The club head 2*a* is fixed to the tip of a shaft 1.

When the parts near the center of gravity G of the club head 2*a* are all fashioned of the abovesaid composite material having low specific gravity and weight inserts 3 and 3 are embedded into positions sufficiently spaced from the center of gravity G as shown in FIG. 1, it is possible to adapt the moment of inertia of the club head around the center of gravity G to be approximately equal to that of a conventional club head made of steel in spite of the reduced weight of the club head. The weight of a club head 2*a* fashioned of the composite material 12*a* with weight inserts 3 according to the present invention is equal to 40 to 90% of a conventional steel club head which is identical in shape and size with the condition that the moment of inertia around the center of gravity G on one club head is almost the same as that of the other. In other words, a club head according to this invention can be reduced 10 to 60% by weight to be lighter than a club head made entirely of steel and having the same configuration and size while maintaining the moment of inertia around the center of gravity of one club head to be approximately equal to that of the other. In this way, a golf club easy to swing for those players lacking physical strength can be produced.

By composing a club head 2*a* of the abovesaid composite material 12*a* and embedding weight inserts made of metal, for example, lead having a specific gravity greater than that of steel into the club head 2*a* at positions distant from the center of gravity G of the club head 2*a* toward the toe side 13 and the heel side 14, the moment of inertia around the center of gravity G can be made greater than that of a club head made entirely of steel and having the same configuration and size without changing the weight of the club head.

A pair of approximately cylindrical weight inserts 3 and 3 shown in FIGS. 1 and 2 may optionally be shaped each like a square column or plate, and, though not illustrated, it is preferable to fashion the outer edges of the toe 13 and the heel 14 of the club head 2*a* of metal such as steel so as to utilize these edges as externally exposed weight pieces.

Figure 3:
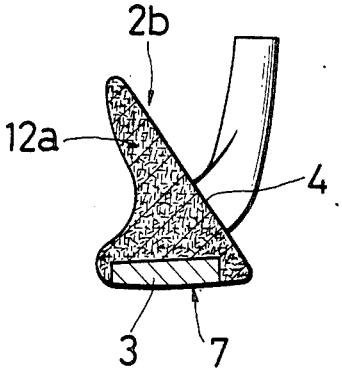
FIGS. 3 through 5 are cross sectional views similar to FIG. 2 and showing other embodiments of the present invention.

Referring to FIG. 3 in which another embodiment of the present invention is shown, a major part of a club head 2*b* is also fashioned of a composite material 12*a* as described above which is composed of light metal containing silicon carbide whiskers in the same manner as that in the case of the previous embodiment. However, this club differs because a weight piece 3 is provided on the side of sole 7 of the club head 2*b*. Provision of weight piece 3 on the side of sole 7 as shown in FIG. 3 makes the center of gravity positionally lower than that of a conventional club head. A volume of composite material occupies 20% or more of the entire volume of club head in the like manner as in the previous embodiment.

For the manufacture of club heads 2*a* and 2*b* as embodiments shown in FIGS. 1 and 2, and FIG. 3, respectively, hot molten light metal is poured into a mold including a multitude of needle-like silicon carbide whiskers pressed into the shape of a club head, thereby turning into a cast product such as a club head. Weight inserts of piece 3 may be embedded into a mass of a multitude of needle-like silicon carbide whiskers which are under pressing so as to be shaped like a club head, or may be mechanically embedded into a composite material 12*a* that has been turned into a cast product.

The portion of the composite material 12*a* other than that composed of a multitude of needle-like silicon carbide whiskers is generally called "matrix". In the embodiments shown in FIGS. 2 and 3, light metal is used as a matrix. In the case of a composite material 12*a* using light metal as a matrix, it is preferable to forge the cast product into any desired shape of club head.

Figure 4:
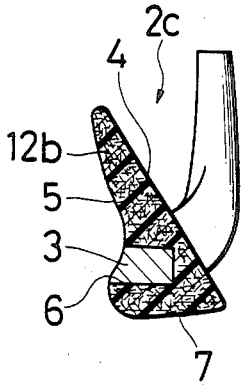
Figure 5:
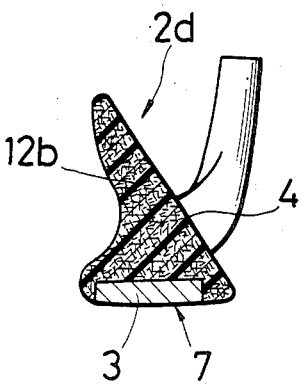

In the other embodiments shown in FIGS. 4 and 5, a composite material 12*b* occupying 20% or more by volume of each of club heads 2*c* and 2*d* contains synthetic resin such as ABS, polypropylene, or nylon as a matrix. Silicon carbide whiskers used in these embodiments are the same as those used in the previous embodiments.

The embodiments in FIG. 4 and FIG. 5 correspond to those in FIG. 2 and FIG. 3, respectively, and, with respect to positions of weight inserts 3, the shape, the value of the moment of inertia of the club head, and the weight thereof are the same as those of the embodiments shown in FIG. 2 and FIG. 3.

When using synthetic resin as a matrix, the content of silicon carbide whiskers in the composite material 12*b* is preferably determined within the range of from 2 to 80% by volume, particularly from 4 to 40%.

When using synthetic resin as a matrix, a club head can easily be fashioned by compression molding or injection molding of a composite material of molten synthetic resin with which a multitude of needle-like silicon carbide single crystal whiskers are mixed.

With reference to FIGS. 6 through 10, results of measurement of various characteristics will be described in detail. Major parts of club heads 2*a* and 2*b* were composed of a composite material made of alumimum containing 20% by volume of silicon carbide whiskers each ranging from 0.2 to 0.5 μm in diameter and from 50 to 200 μm in length. Characters P/W and S/W in the drawings stand for a pitching wedge club and sand wedge, respectively.

Figure 6:
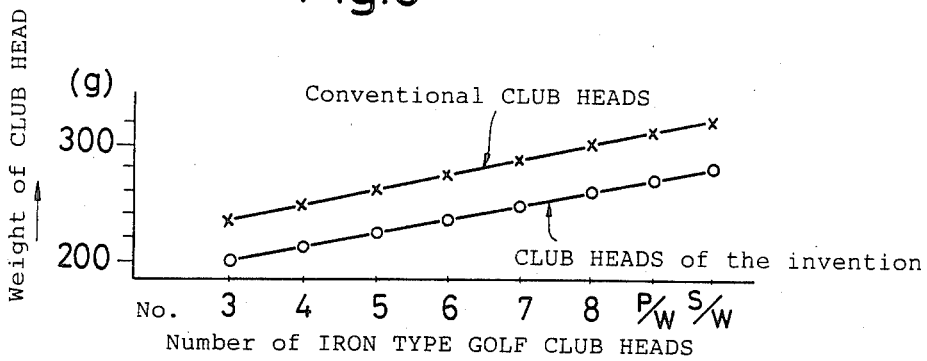
FIG. 6 is a graph showing values of the weight of the club head numbered in order for comparison when conventional club heads and those according to this invention were constructed so that both kinds of club heads are adapted to possess the same degree of moment of inertia.

FIG. 6 is a graph in which the abscissa and ordinate indicate the number of the iron type golf club heads and the weight thereof, respectively. A club head 2*a* was fashioned in such a way that dimensions l and h as shown in FIG. 1 were set at 35 mm and 25 mm, respectively, and a weight insert at 51 g, (that is 102 g for the pair) while the moment of inertia was maintained at the same degree as that of a conventional club head, thereby having enabled significant reduction in the weight thereof. For instance, regarding the No. 3 iron club and sand wedge iron, it is apparent that the weight of the former club head weighing 230 g and that of the latter 320 g were reduced to 200 and 280 g, respectively.

Figure 7:
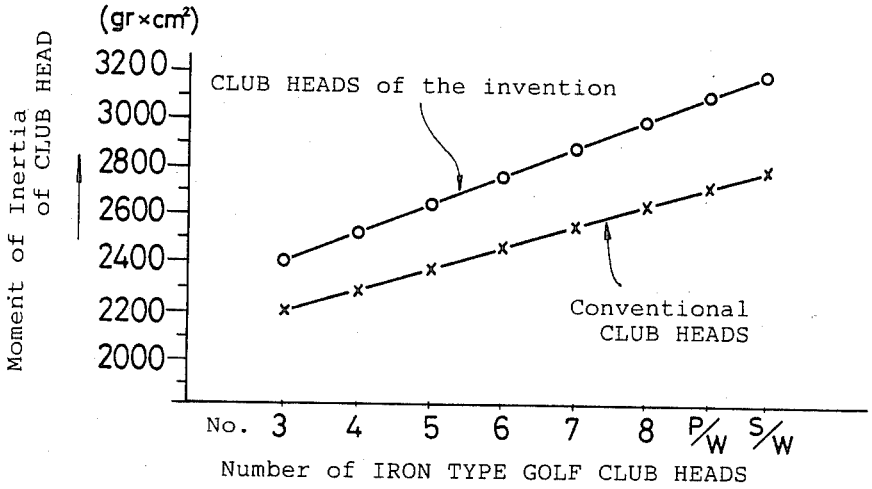
FIG. 7 is a graph showing the values of the moment of inertia of club heads numbered in order for comparison when conventional club heads and those according to this invention were constructed so that both kinds of club heads have an equal weight.

FIG. 7 is a graph in which the abscissa and ordinate represent the number of the iron type golf club heads and the degree of the moment of inertia thereof, respectively, from which it is understood that the moment of inertia of a club head 2*a* according to this invention was far greater than that of a conventional iron type club head with the condition that the configuration and structure thereof were as shown in FIG. 1 and also the configuration and weight thereof were identical with those of a conventional one.

Figure 8:
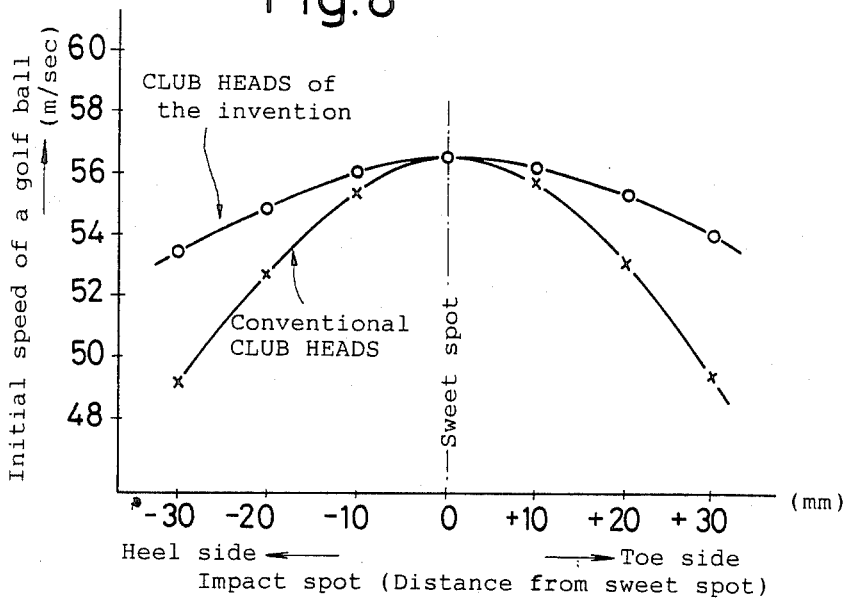
FIG. 8 is a graph for comparison between the conventional club heads and those according to this invention, in which it is shown how much the initial speed of a golf ball dropped depending on the impact spot when a spot other than the sweet spot of the club head hit against the golf ball.

FIG. 8 is a graph in which the abscissa indicates the impact spot, when the sweet spot is numerically set at 0 (zero) and the side of toe and that of heel are assumed to be a plus and minus, respectively. The ordinate indicates the initial speed of a golf ball. As apparent from this graph, the drop of the initial speed of a golf ball was abrupt when the spot other than the sweet spot hit against the golf ball in the case of the conventional club head but was gradual in the case of a club head 2*a* according to this invention whose structure was a shown in FIG. 1 and configuration and weight were identical with those of the conventional one, even when the golf ball was mishit.

Figure 9:
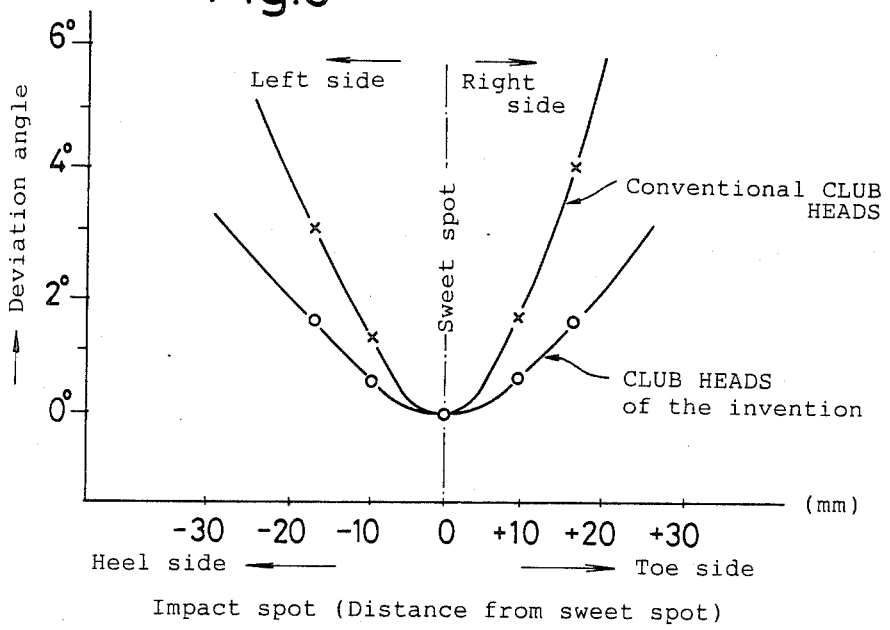
FIG. 9 is a graph for comparison between the conventional club heads and those according to this invention, in which it is shown, in terms of the deviation angle, how much a golf ball deviates right (slice) or left (hook) depending on the impact spot when a spot other than the sweet spot of the club head hits against the golf ball.

FIG. 9 is a graph in which the abscissa indicates the impact spot (similarly to FIG. 8) and the ordinate denotes the deviation angle. The deviation angle means the angle of deviation of the path of a golf ball flying right (slice) or left (hook) from the proper course. A club head 2*a* according to this invention having the same configuration and weight as a conventional iron and having the structure as shown in FIG. 1 but having the increased moment of inertia, was measured. From the graph in FIG. 9, it is clearly understood that control over the flying direction of a golf ball was markedly improved by the use of a club head according to this invention in which the moment of inertia was increased and by which the deviation angle of a golf ball was rendered small.

Figure 10:
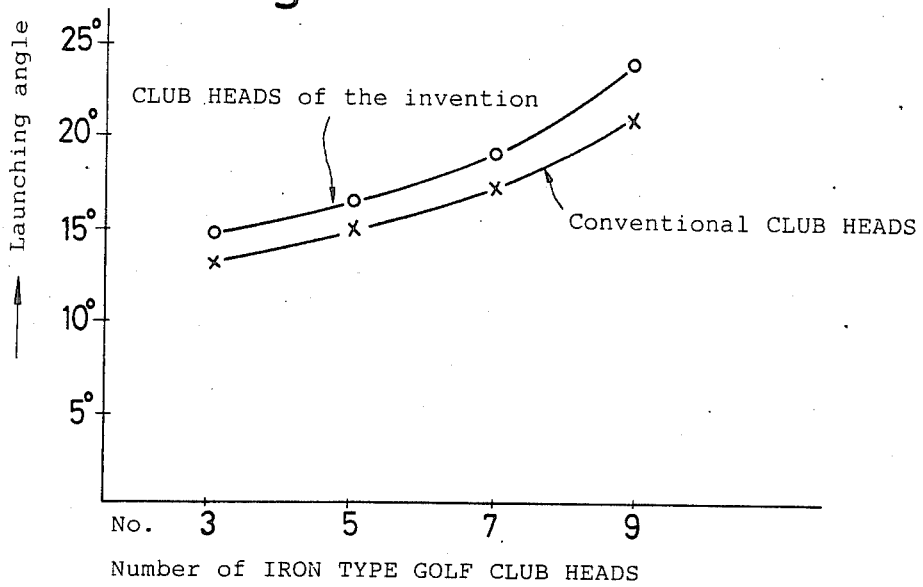
FIG. 10 is a graph for comparison between the conventional club heads and those according to this invention, in which is shown the launching angle formed between the ground and the initial path of a golf ball when the ball was hit by a club head according to this invention like an embodiment shown in FIG. 3 which is provided with weight inserts embedded into the sole portion thereof with respect to club heads numbered in order.

FIG. 10 is a graph in which the abscissa and ordinate indicate the order number of golf club heads and the launching angle of a golf ball, respectively, for comparing a club head provided with weight inserts at the side of sole 7 thereof as shown in FIG. 3 with a conventional one, both club heads being equal to each other in weight. As apparent from the graph shown in FIG. 10, a club head 2*b* according to this invention enabled an increase in the degree of the launching angle of golf ball, thereby favorably increasing the flying distance of the ball.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A golf club comprising an iron type golf club head formed of a composite material comprising light metal containing silicon carbide whiskers and occupying 20% or more by volume of said club head.

2. A golf club as defined in claim 1, wherein the content of said silicon carbide whiskers in the composite material ranges from 2 to 80% by volume.

3. A golf club as defined in claim 2, wherein the content of said silicon carbide whiskers in the composite material ranges from 4 to 40% by volume.

4. A golf club as defined in claim 1, wherein the specific gravity of said composite material is equal to 40% or less than the specific gravity of steel.

5. A golf club as defined in claim 4, wherein said head has a sole portion with weight inserts embedded therein.

6. A golf club as defined in claim 1, wherein each of said silicon carbide whiskers ranges from 0.1 to 1.0 um in diameter and the aspect ratio ranges from 50 to 300.

7. The iron type golf club according to claim 1, wherein the light metal is selected from the group consisting of aluminum, aluminum alloy, magnesium, magnesium alloy, titanium and titanium alloy.

8. A golf club comprising an iron type golf club head formed of a composite material comprising synthetic resin containing silicon carbide whiskers and occupying 20% or more by volume of said club head.

9. A golf club as defined in claim 8, wherein the content of said silicon carbide whiskers in the composite material ranges from 2 to 80% by volume.

10. A golf club as defined in claim 9, wherein the content of said silicon carbide whiskers in the composite material ranges from 4 to 40% by volume.

11. A golf club as defined in claim 8, wherein the specific gravity of said composite material is equal to 40% or less than the specific gravity of steel.

12. A golf club as defined in claim 11, wherein said head has a sole portion with weight inserts embedded therein.

13. A golf club as defined in claim 8, wherein each of said silicon carbide whiskers ranges from 0.1 to 1.0 μm in diameter and the aspect ratio ranges from 50 to 300.

14. A golf club comprising an iron type golf club head formed of a composite material comprising light metal containing silicon carbide whiskers and occupying 20% or more by volume of said club head so that the weight of said club head is 10 to 60% lighter than a club head made entirely of steel having the same configuration and size with the condition that the moment of inertia is approximately the same.

15. An iron type golf club as defined in claim 14, wherein weight inserts are embedded into portions lying apart from the center of gravity of the club head on lower portions thereof.

16. The iron type golf club according to claim 14, wherein the light metal is selected from the group consisting of aluminum, aluminum alloy, magnesium, magnesium alloy, titanium and titanium alloy.

17. A golf club comprising an iron type golf club head formed of a composite material comprising synthetic resin containing silicon carbide whiskers and occupying 20% or more by volume of said club head so that the weight of said club head is reduced by 10 to 60% to be lighter than a club head made entirely of steel and having approximately the same configuration and size as the club head made entirely of steel.

18. A golf club as defined in claim 17, wherein weight inserts are embedded into portions lying apart from the center of gravity of the club head on lower portions thereof.

19. A golf club comprising an iron type golf club head formed of a composite material comprising light metal containing silicon carbide whiskers and forming a major part of said head, provided with metal weight inserts each having a specific gravity greater than that of steel and embedded into portions lying apart from the center of gravity of the club head on lower portions thereof, and adapted to possess an increased moment of inertia around said center of gravity with the condition that the configuration, size, and weight of said club head are identical with those of a club head made entirely of steel.

20. The iron type golf club according to claim 19, wherein the light metal is selected from the group consisting of aluminum, aluminum alloy, magnesium, magnesium alloy, titanium and titanium alloy.

21. A golf club comprising an iron type golf club head formed of a composite material comprising synthetic resin containing silicon carbide whiskers and forming a major part of said club head, provided with weight metal inserts each having a specific gravity greater than the specific gravity of steel and embedded into portions lying apart from the center of gravity of the club head on the lower portions thereof, and adapted to possess an increased moment of inertia around said center of gravity with the condition that the configuration, size, and weight of said club head are identical with those of a club head made entirely of steel.

22. A golf club comprising an iron type golf club head formed of a composite material comprising synthetic resin containing silicon carbide whiskers and forming a major part of said club head, provided with a weight metal insert having a specific gravity greater than the specific gravity of steel and embedded into a sole portion of the club head with the condition that the configuration, size, and weight of said club head are identical with those of a club head made entirely of steel.

23. A golf club comprising an iron type golf club head formed of a composite material comprising synthetic resin containing silicon carbide whiskers and forming a major part of said club head, provided with a weight metal insert having a specific gravity greater than the specific gravity of steel and embedded in a sole portion of the club head with the condition that the configuration, size, and weight of said club head are identical with those of a club head made entirely of steel.

* * * * *